US006681727B2

(12) United States Patent
Krenn

(10) Patent No.: US 6,681,727 B2
(45) Date of Patent: Jan. 27, 2004

(54) CYLINDER HEAD FOR A PLURALITY OF CYLINDERS

(75) Inventor: Hermann Krenn, St. Peter Bei Judenburg (AT)

(73) Assignee: AVL List GmbH, Graz (AT)

( * ) Notice: Subject to any disclaimer, the term of this patent is extended or adjusted under 35 U.S.C. 154(b) by 0 days.

(21) Appl. No.: 10/055,009

(22) Filed: Jan. 25, 2002

(65) Prior Publication Data

US 2002/0129776 A1 Sep. 19, 2002

(30) Foreign Application Priority Data

Jan. 29, 2001 (AT) ..... 72/2001 U

(51) Int. Cl.[7] ..... F02F 1/36
(52) U.S. Cl. ..... 123/41.82 R; 123/193.5
(58) Field of Search ..... 123/41.82 R, 193.5, 123/41.76, 41.77, 41.78, 41.79, 41.82 A, 41.72, 41.74, 41.31, 193.1

(56) References Cited

U.S. PATENT DOCUMENTS

| | | | | |
|---|---|---|---|---|
| 4,121,550 A | * | 10/1978 | Wand et al. | 123/41.31 |
| 4,304,199 A | | 12/1981 | Formia et al. | |
| 4,660,527 A | | 4/1987 | Tanaka et al. | |
| 4,889,079 A | * | 12/1989 | Takeda et al. | 123/41.82 R |
| 5,295,462 A | * | 3/1994 | Barnes et al. | 123/193.5 |
| 6,279,516 B1 | * | 8/2001 | Haugen et al. | 123/41.82 R |

FOREIGN PATENT DOCUMENTS

| | | |
|---|---|---|
| CH | 614995 | 12/1979 |
| DE | 1961322 | 6/1971 |
| DE | 2437965 | 2/1976 |
| DE | 2452999 | 6/1976 |
| DE | 4222801 | 1/1994 |
| DE | 2460972 | 7/1996 |
| JP | 60-74041 | 3/1994 |
| JP | 2000-104624 | 4/2000 |

* cited by examiner

*Primary Examiner*—Henry C. Yuen
*Assistant Examiner*—Hyder Ali
(74) *Attorney, Agent, or Firm*—Dykema Gossett PLLC

(57) ABSTRACT

This invention relates to a cylinder head (1) for a plurality of cylinders (A,B,C) for a liquid-cooled internal combustion engine, with a cooling chamber configuration (3) adjacent to a fire deck (2), which is divided by an intermediate deck (4) essentially parallel to the fire deck (2) into a lower cooling chamber (5) next to the fire deck (2), and an upper cooling chamber (7) adjoining the lower cooling chamber (5) in the direction of the cylinder axis (6), where lower and upper cooling chamber (5, 7) communicate with each other via at least one flow opening, and where at least one coolant inlet (13) per cylinder (A,B,C), which is preferably located in the fire deck (2), opens into the lower cooling chamber (5), and at least one coolant outlet departs from the upper cooling chamber (7). For the purpose of improved cooling a lower cooling chamber (5) is associated with each cylinder (A,B, C) and the lower cooling chambers (5) of at least two adjacent cylinders (A,B,C) are substantially separated from each other by a partitioning wall (12) and the upper cooling chamber (7) extends over at least two cylinders (A,B,C).

8 Claims, 3 Drawing Sheets

CYLINDER HEAD FOR A PLURALITY OF CYLINDERS

BACKGROUND OF THE INVENTION

The invention relates to a cylinder head for a plurality of cylinders for a liquid-cooled internal combustion engine, with a configuration for a cooling chamber adjacent to a fire deck, which is divided by an intermediate deck essentially parallel to the fire deck into a lower cooling chamber next to the fire deck, and an upper cooling chamber adjoining the lower one in the direction of the cylinder axis, where the two chambers communicate with each other via at least one flow opening, and where at least one coolant inlet per cylinder, which is preferably located in the fire deck, opens into the lower cooling chamber, and at least one coolant outlet departs from the upper cooling chamber.

In powerful compression-ignition internal combustion engines with strong heat generation, for example, a single continuous cooling chamber for a coolant passing longitudinally through the cylinder head will not provide sufficient cooling of the fire deck. Insufficient heat transfer from the cylinder head, however, may lead to material deformation, leaks and cracking.

DESCRIPTION OF PRIOR ART

In CH 614 995 A a single-cylinder cylinder head for a compression-ignition engine is disclosed, with a lower cooling chamber on the side of the fire deck and an upper cooling chamber, the two cooling chambers being separated by a partition. The coolant is supplied via a feed pipe to annular coolant passages around the valve seats on the one hand, and to the lower cooling chamber on the other hand. From the coolant passages around the valve seats the coolant will flow into a central annular space surrounding a sleeve for a fuel intake device. This is the point from where the coolant will flow into the upper cooling chamber. In this way fire deck and valve seats will be cooled independently. DE 24 60 972 A1 also discloses a single-cylinder cylinder head with two coolant chambers positioned one above the other, which communicate via openings. Such designs are not suitable for engine cylinder heads for a plurality of cylinders, however.

From U.S. Pat. No. 4,304,199 A a cylinder head for a plurality of cylinders for a compression-ignition engine is known, which is provided with a cooling chamber separated by a dividing wall into a lower and an upper part. Upper and lower part are flow-connected by an arcuate opening partially extending along the circumference of the seat of a fuel injector. Via inlet openings in the fire deck the coolant is passed from the cylinder block into the lower part of the cooling chamber, and from there via said arcuate openings into the upper part. The lower part is designed as a continuous space for several adjacent cylinders, so that a longitudinal flow will be generated as well, at least partially. In the instance of strong heat generation in the combustion chamber, it will not be possible to ensure sufficient cooling.

SUMMARY OF THE INVENTION

It is the object of the present invention to improve cooling in a cylinder head of the above type, especially in the area of the fire deck.

This object is achieved by associating a lower cooling chamber with each cylinder and by providing that the lower cooling chambers of at least two adjacent cylinders be substantially separated from each other by a partitioning wall and that the upper cooling chamber extend over at least two cylinders. Complete separation of the lower cooling chambers of two adjacent cylinders will prevent a longitudinal coolant flow. The configuration proposed by the invention will also be of advantage for casting. The use of single cores with a compact structure will greatly facilitate the casting of separate lower cooling chambers since there is little danger of distortion. As a consequence, problems with the casting process are minimized.

The coolant will pass through the lower cooling chambers essentially transversally to the cylinder head. This will permit the heat transfer to be precisely defined for each individual cylinder and thus help avoid any influence on cooling performance due to longitudinal coolant flow. In order to avoid vapour lock in the lower cooling chamber when the engine is tilted, it will be of advantage if at least one vent is provided for each cylinder between upper and lower cooling chamber. In this context it is proposed that the vent should be positioned in the area between a longitudinal engine plane and a side-wall of the cylinder head, preferably in a transverse engine plane containing the cylinder axis.

In an enhanced variant of the invention the proposal is put forward that in a cylinder head with at least one fuel injector per cylinder, the intermediate deck be provided with an opening receiving a pipe for insertion of the fuel injector, an annular passage with predefined cross-section being provided between said opening and the pipe, which passage serves as a flow opening between upper and lower cooling chamber.

Alternatively it may be provided that the intermediate deck have a, preferably cast, stub receiving the fuel injector. In order to ensure sufficient coolant supply of the upper cooling chamber, at least one flow opening should be formed by a transfer port in the intermediate deck, and preferably in the area of a side-wall. Significant transverse flow of the coolant in the lower cooling chamber will be obtained by arranging for the inlets and transfer ports to be disposed on opposite side-walls relative to the longitudinal engine plane.

To achieve sufficient cooling of the seat of the fuel injector the lower cooling chamber should preferably surround the fuel injector along its entire circumference in the area of an injector nozzle of the fuel injector opening directly into the combustion chamber.

BRIEF DESCRIPTION OF THE DRAWINGS

The invention will now be explained in more detail with reference to the attached drawings, wherein.

DETAILED DESCRIPTION OF PREFERRED EMBODIMENTS

Figure 1:
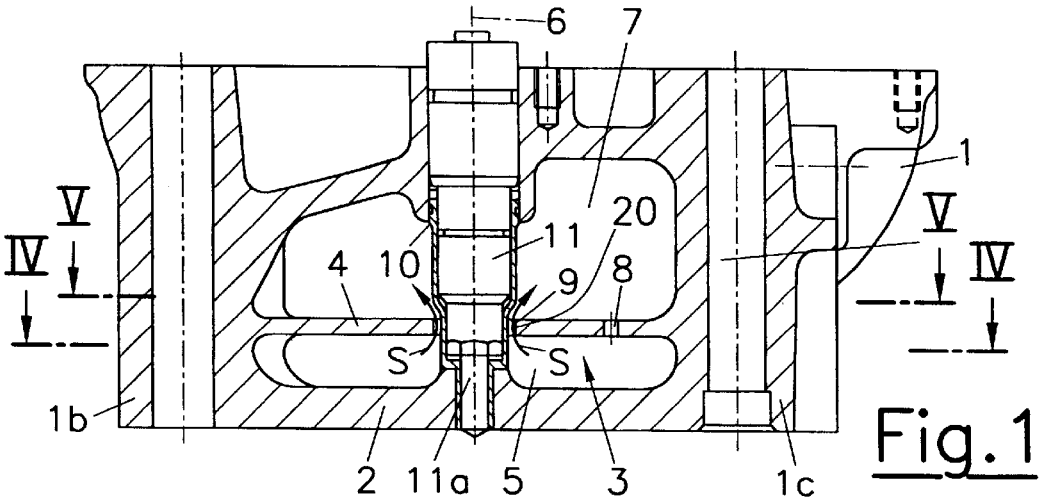
FIG. 1 shows a cylinder head in accordance with the invention, in a cross-section along line I—I in FIG. 4, in a first variant.
Figure 2:
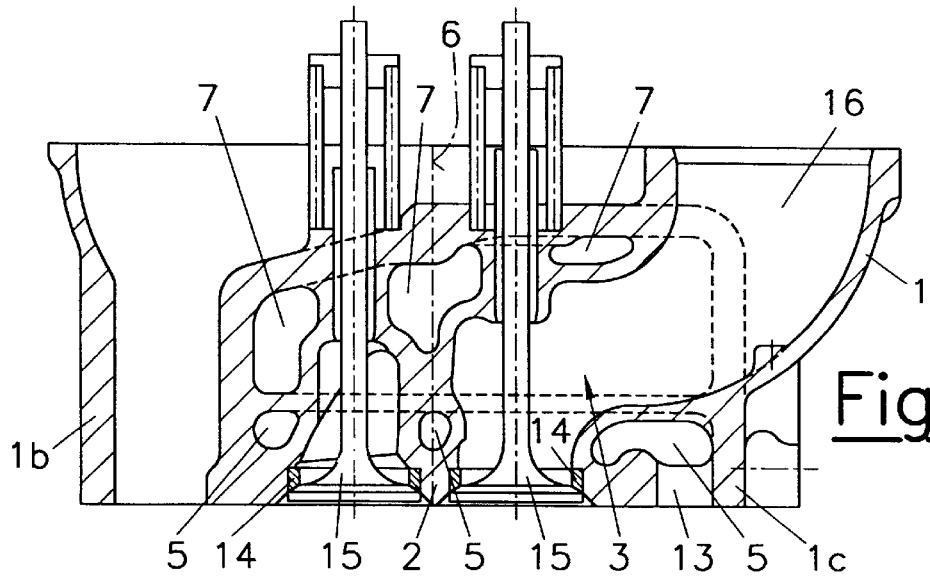
FIG. 2 shows the cylinder head in a cross-section along line II—II in FIG. 4.
Figure 3:
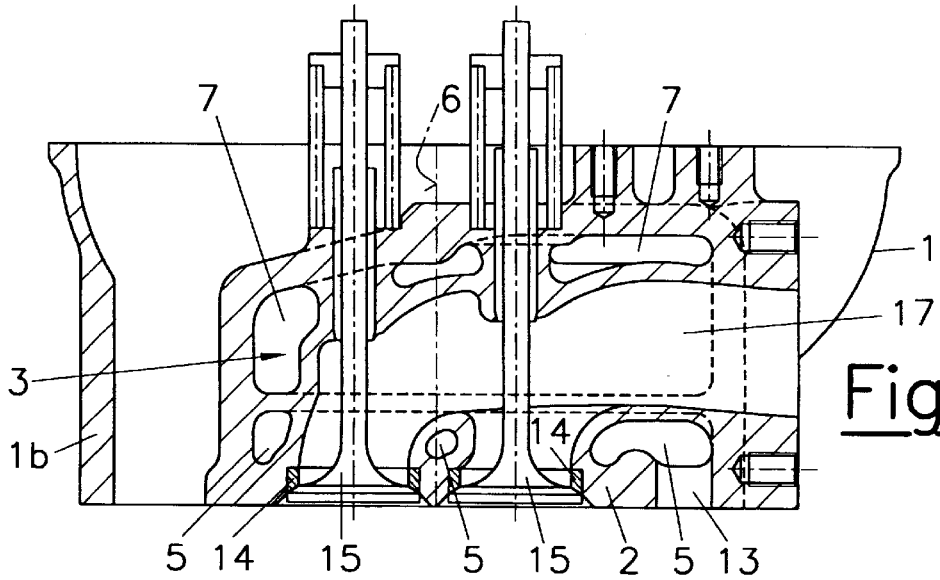
FIG. 3 shows the cylinder head in a cross-section along line III—III in FIG. 4.

The cylinder head 1, which is configured as an integral unit for a plurality of cylinders A,B,C, is characterized by a cooling chamber configuration 3 adjacent to a fire deck 2 on the side of the combustion chamber, which configuration 3 is divided by an intermediate deck 4 into a lower cooling chamber 5 next to the fire deck 2, and an upper cooling chamber 7 adjoining the lower chamber in the direction of the cylinder axis 6. The intermediate deck 4 has at least one flow opening for each cylinder A,B,C. In the first variant shown in FIGS. 1 to 5 the flow opening is configured as an annular passage 9 with defined flow cross-section between the intermediate deck 4 and a pipe 10 for insertion of a fuel injector 11, which pipe 10 passes through an opening 20 in the intermediate deck 4. In the second variant according to FIGS. 6 and 7 the inlet openings 13 are positioned only in the area of a side-wall 1*c*, and the flow openings are formed by transfer ports 22 in the intermediate deck 4 in the area of the opposite side-wall 1*b*. The fuel injector 11 may be received in a stub 21 of the intermediate deck 4 cast integrally with the cylinder head 1. In order to permit venting and the escaping of vapor bubbles from the lower cooling chamber 5 when the engine is tilted, at least one vent 8 is provided for each cylinder 1 between the longitudinal engine plane 23 and a side-wall 1*c*, preferably in the area of a transverse engine plane 18 containing the cylinder axis 6, i.e., close to the cylinder jacket 19 in a view from above.

Figure 4:
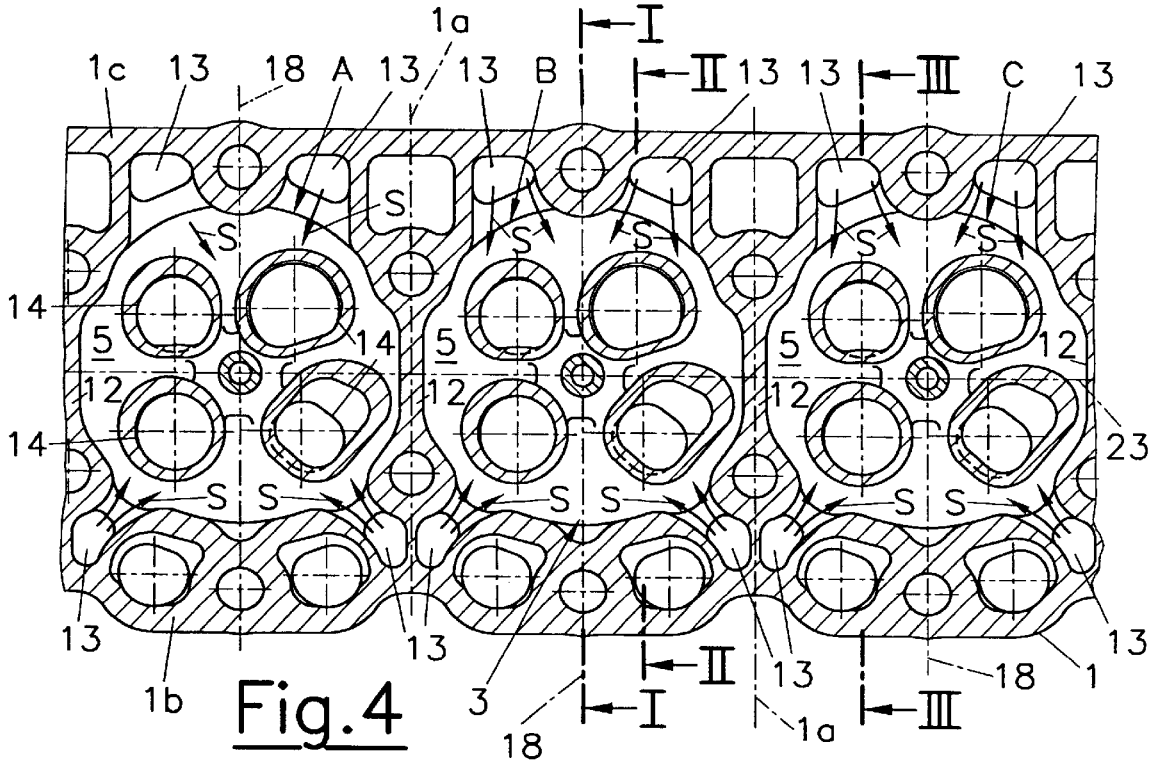
FIG. 4 shows the cylinder head in a section along line IV—IV in FIG. 1.
Figure 5:
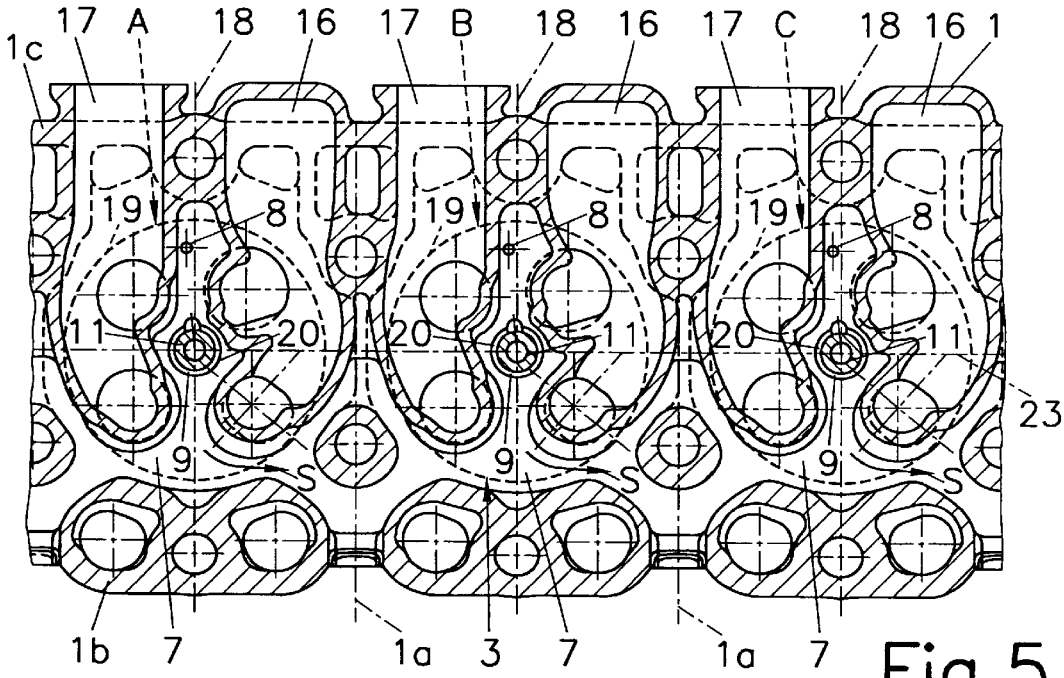
FIG. 5 shows the cylinder head in a section along line V—V in FIG. 1, FIGS. 6 and 7 show a cylinder head in accordance with the invention, in sections analogous to FIGS. 4 and 5, in a second variant.
Figure 6:
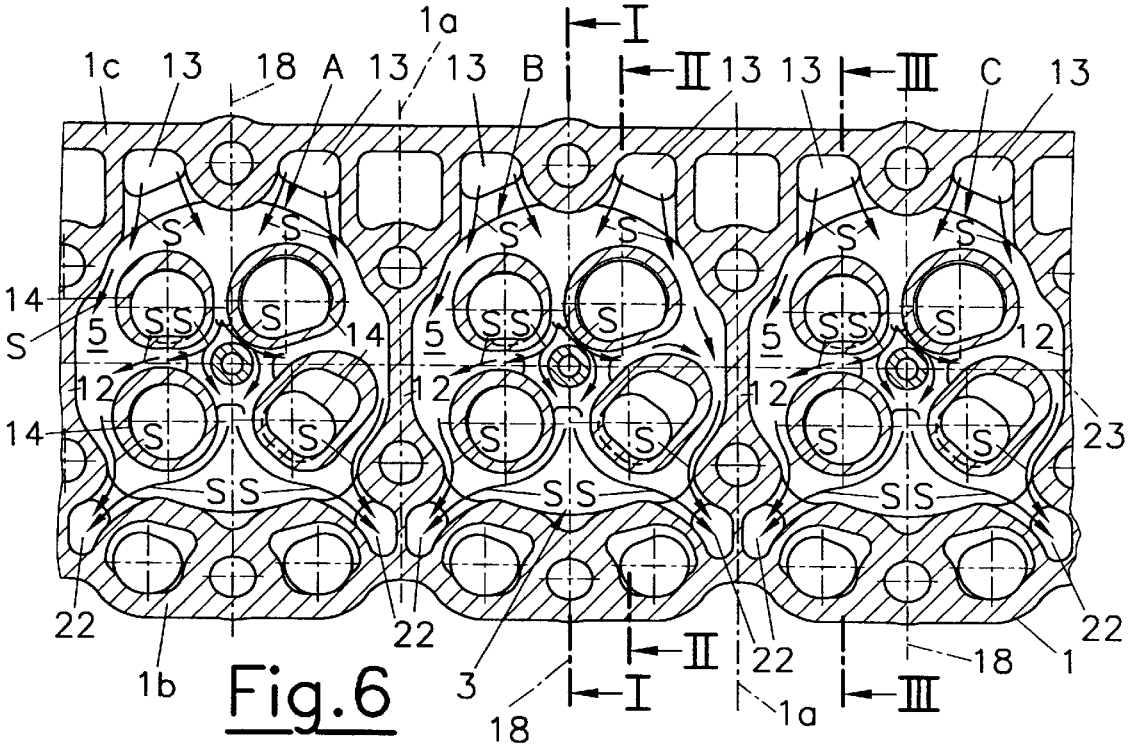
Figure 7:
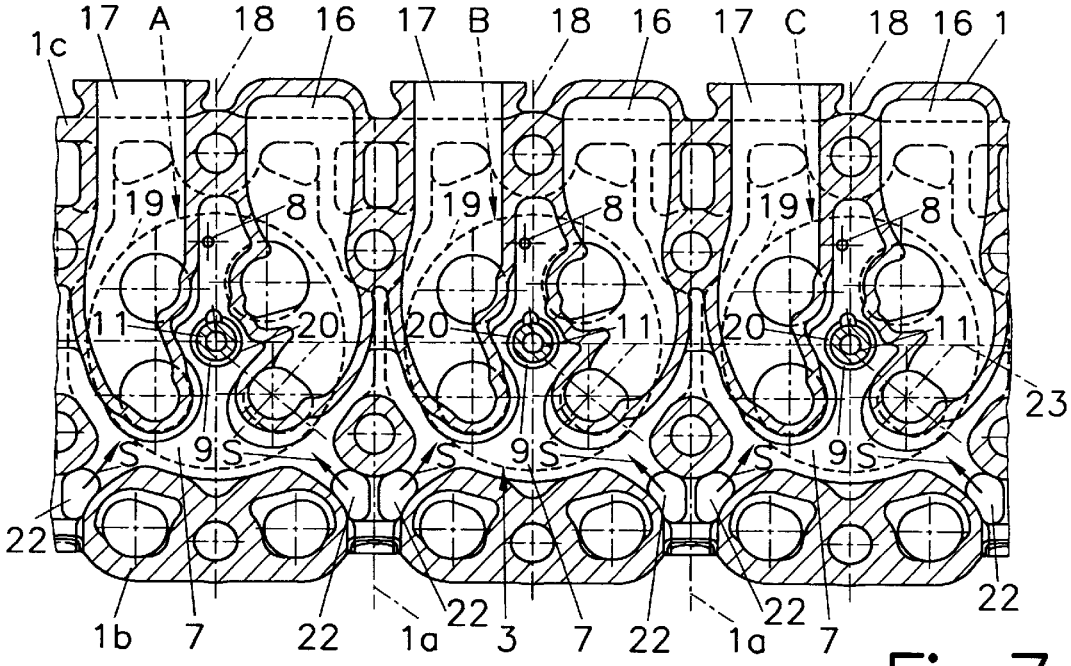

As is seen from FIGS. 4 and 6, the lower cooling chambers 5 of two adjacent cylinders A,B,C are separated from each other by a partitioning wall 12 each. Said partitioning walls 12 each are located in the area of a transverse engine plane 1*a* in the cylinder head 1.

In the drawings numerals 16 and 17 refer to charge exchange passages.

The coolant will flow through inlet openings 13 in the area of side-walls 1*b*, 1*c* (FIG. 4) and side-wall 1*c* (FIG. 6) of the cylinder head 1 essentially in transverse direction along arrows S into the lower cooling chamber 5. The coolant will flow around the areas surrounding the valve seats 14 of valves 15 and the fuel injector 11, providing for optimum cooling. From the lower cooling chamber 5 the coolant will pass through flow openings—annular passages 9 and/or transfer ports 22—into the upper cooling chamber 7, and will flow through the upper chamber 7 designed as a single continuous space for all cylinders A,B,C in longitudinal direction of the cylinder head 1. Via at least one outlet not further shown in this drawing the coolant will leave the cylinder head 1. This outlet may be located at a front end of the cylinder head. Alternatively, the upper cooling chamber may be provided with a collecting rail for the discharged coolant.

The important feature is that the coolant flow through the lower cooling chamber 5, and thus cooling of the fire deck 2, takes place separately for each cylinder A,B,C, i.e., independently of the adjacent cylinder. In this way optimum heat transfer will be ensured for each individual cylinder A,B,C.

What is claimed is:

1. A cylinder head for a plurality of cylinders of a liquid-cooled internal combustion engine, said cylinder head defining a fire deck; a cooling chamber adjacent the fire deck; an intermediate deck which is essentially parallel to the fire deck and which divides the cooling chamber into a lower cooling chamber next to the fire deck and an upper cooling chamber remote from the fire deck, a lower cooling chamber being associated with each cylinder and a partitioning wall substantially separating two lower cooling chambers associated with at least two adjacent cylinders, the upper cooling chamber extending over at least two cylinders, the intermediate deck including an opening; a coolant inlet per cylinder communicating with a lower cooling chamber; a coolant outlet communicating with an upper cooling chamber; a pipe for a fuel injector located in said opening in said intermediate deck so as to leave an annular passage between the opening and the pipe to function as a flow opening communicating coolant between lower and upper cooling chambers; at least one vent for each cylinder between upper and lower cooling chamber; the intermediate deck including at least one transfer port located in an area of a side-wall.

2. The cylinder head according to claim 1, including at least one coolant inlet in the fire deck.

3. The cylinder head according to claim 1, wherein the partitioning wall is located in the area of a transverse engine plane between two adjacent cylinders.

4. The cylinder head according to claim 1, wherein the vent is positioned in an area between a longitudinal engine plane and a side-wall of the cylinder head.

5. The cylinder head according to claim 4, wherein the vent is positioned in a transverse engine plane containing the cylinder axis.

6. The cylinder head according to claim 1, including at least one fuel injector per cylinder located in the cylinder head, and wherein the intermediate deck includes a cast stub receiving the fuel injector.

7. The cylinder head according to claim 1, wherein the inlets and transfer ports are disposed on opposite side-walls relative to a longitudinal engine plane.

8. The cylinder head according to claim 1, wherein the lower cooling chamber surrounds the fuel injector along its entire circumference in the area of an injector nozzle of a fuel injector opening directly into a combustion chamber.

* * * * *